US006334455B1

(12) United States Patent
Nunez, Sr.

(10) Patent No.: US 6,334,455 B1
(45) Date of Patent: Jan. 1, 2002

(54) TENT TIE-DOWN DEVICE

(76) Inventor: Mario Nunez, Sr., 1171 Englander St., P.O. Box #376, San Pedro, CA (US) 90733

( * ) Notice: Subject to any disclaimer, the term of this patent is extended or adjusted under 35 U.S.C. 154(b) by 0 days.

(21) Appl. No.: 09/663,126

(22) Filed: Sep. 15, 2000

(51) Int. Cl.[7] ..... E04H 15/32

(52) U.S. Cl. ..... 135/120.4; 135/118; 135/119; 135/120.3; 135/120.1

(58) Field of Search ..... 135/120.1, 120.3, 135/120.4, 118, 119; 52/3, 4, 5

(56) References Cited

U.S. PATENT DOCUMENTS

| | | | | | |
|---|---|---|---|---|---|
| 74,933 | A | * | 2/1868 | Palmer | 135/87 |
| 612,636 | A | * | 10/1898 | Zusi | 135/87 |
| 1,092,707 | A | * | 4/1914 | Freeland | 135/87 |
| 3,404,696 | A | * | 10/1968 | Filho | 135/87 |
| 3,788,336 | A | | 1/1974 | Steffes | |
| 4,185,424 | A | | 1/1980 | Streit | |
| 4,305,414 | A | | 12/1981 | Bareis | |
| 5,246,303 | A | * | 9/1993 | Trilla et al. | 403/353 |
| 5,409,330 | A | * | 4/1995 | Baines et al. | 135/87 |
| 5,540,014 | A | | 7/1996 | Smith | |
| 5,564,232 | A | | 10/1996 | Callaway | |
| 5,573,028 | A | * | 11/1996 | van der Stigohel | 134/147 |
| D377,076 | S | | 12/1996 | Adams | |
| 5,771,912 | A | * | 6/1998 | Swetish | 135/87 |
| 6,226,813 | B1 | * | 5/2001 | Wilburn et al. | 135/87 |

* cited by examiner

*Primary Examiner*—Beth A. Stephan
*Assistant Examiner*—Dennis L. Dorsey

(57) ABSTRACT

A tent tie-down device for allowing the user to quickly tie down one's tent to the ground. The tent tie-down device includes a flexible line having a first end portion and a second end portion; and also includes a bead member having a open ends and a bore extending therethrough and being adapted to receive the first end portion of the flexible line with the bead member being attached to the first end portion of the flexible line; and further includes a stake member having a shaft portion and a head portion which is removably attached to the second end portion of the flexible line.

9 Claims, 3 Drawing Sheets

TENT TIE-DOWN DEVICE

BACKGROUND OF THE INVENTION

1. Field of the Invention

The present invention relates to a tent tie down and more particularly pertains to a new tent tie-down device for allowing the user to quickly tie down one's tent to the ground.

2. Description of the Prior Art

The use of a tent tie down is known in the prior art. More specifically, a tent tie down heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,788,336; 5,564,232; 5,540,014; 4,305,414; 4,185,424; and 377,076.

While these devices fulfill their respective, particular objectives and requirements, the aforementioned patents do not disclose a new tent tie-down device. The inventive device includes a flexible line having a first end portion and a second end portion; and also includes a bead member having a open ends and a bore extending therethrough and being adapted to receive the first end portion of the flexible line with the bead member being attached to the first end portion of the flexible line; and further includes a stake member having a shaft portion and a head portion which is removably attached to the second end portion of the flexible line.

In these respects, the tent tie-down device according to the present invention substantially departs from the conventional concepts and designs of the prior art, and in so doing provides an apparatus primarily developed for the purpose of allowing the user to quickly tie down one's tent to the ground.

SUMMARY OF THE INVENTION

In view of the foregoing disadvantages inherent in the known types of tent tie down now present in the prior art, the present invention provides a new tent tie-down device construction wherein the same can be utilized for allowing the user to quickly tie down one's tent to the ground.

The general purpose of the present invention, which will be described subsequently in greater detail, is to provide a new tent tie-down device which has many of the advantages of the tent tie down mentioned heretofore and many novel features that result in a new tent tie-down device which is not anticipated, rendered obvious, suggested, or even implied by any of the prior art tent tie down, either alone or in any combination thereof.

To attain this, the present invention generally comprises a flexible line having a first end portion and a second end portion; and also includes a bead member having a open ends and a bore extending therethrough and being adapted to receive the first end portion of the flexible line with the bead member being attached to the first end portion of the flexible line; and further includes a stake member having a shaft portion and a head portion which is removably attached to the second end portion of the flexible line.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tent tie-down device which has many of the advantages of the tent tie down mentioned heretofore and many novel features that result in a new tent tie-down device which is not anticipated, rendered obvious, suggested, or even implied by any of the prior art tent tie down, either alone or in any combination thereof.

It is another object of the present invention to provide a new tent tie-down device which may be easily and efficiently manufactured and marketed.

It is a further object of the present invention to provide a new tent tie-down device which is of a durable and reliable construction.

An even further object of the present invention is to provide a new tent tie-down device which is susceptible of a low cost of manufacture with regard to both materials and labor, and which accordingly is then susceptible of low prices of sale to the consuming public, thereby making such tent tie-down device economically available to the buying public.

Still yet another object of the present invention is to provide a new tent tie-down device which provides in the apparatuses and methods of the prior art some of the advantages thereof, while simultaneously overcoming some of the disadvantages normally associated therewith.

Still another object of the present invention is to provide a new tent tie-down device for allowing the user to quickly tie down one's tent to the ground.

Yet another object of the present invention is to provide a new tent tie-down device which includes a flexible line having a first end portion and a second end portion; and also includes a bead member having a open ends and a bore extending therethrough and being adapted to receive the first end portion of the flexible line with the bead member being attached to the first end portion of the flexible line; and further includes a stake member having a shaft portion and a head portion which is removably attached to the second end portion of the flexible line.

Still yet another object of the present invention is to provide a new tent tie-down device that allows the user to quickly and conveniently set up one's tent.

Even still another object of the present invention is to provide a new tent tie-down device that saves the user substantial time in setting up one's tent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
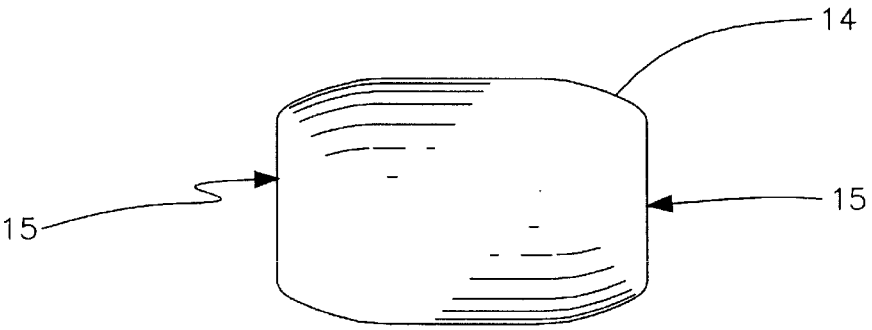
FIG. 1 is a side elevational view of the bead member of a new tent tie-down device according to the present invention.
Figure 2:
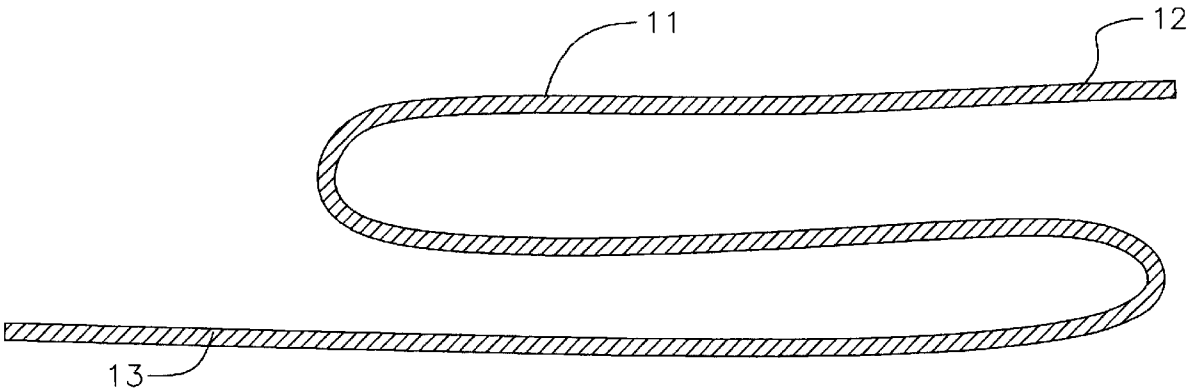
FIG. 2 is a side elevational view of the flexible line of the present invention.
Figure 3:
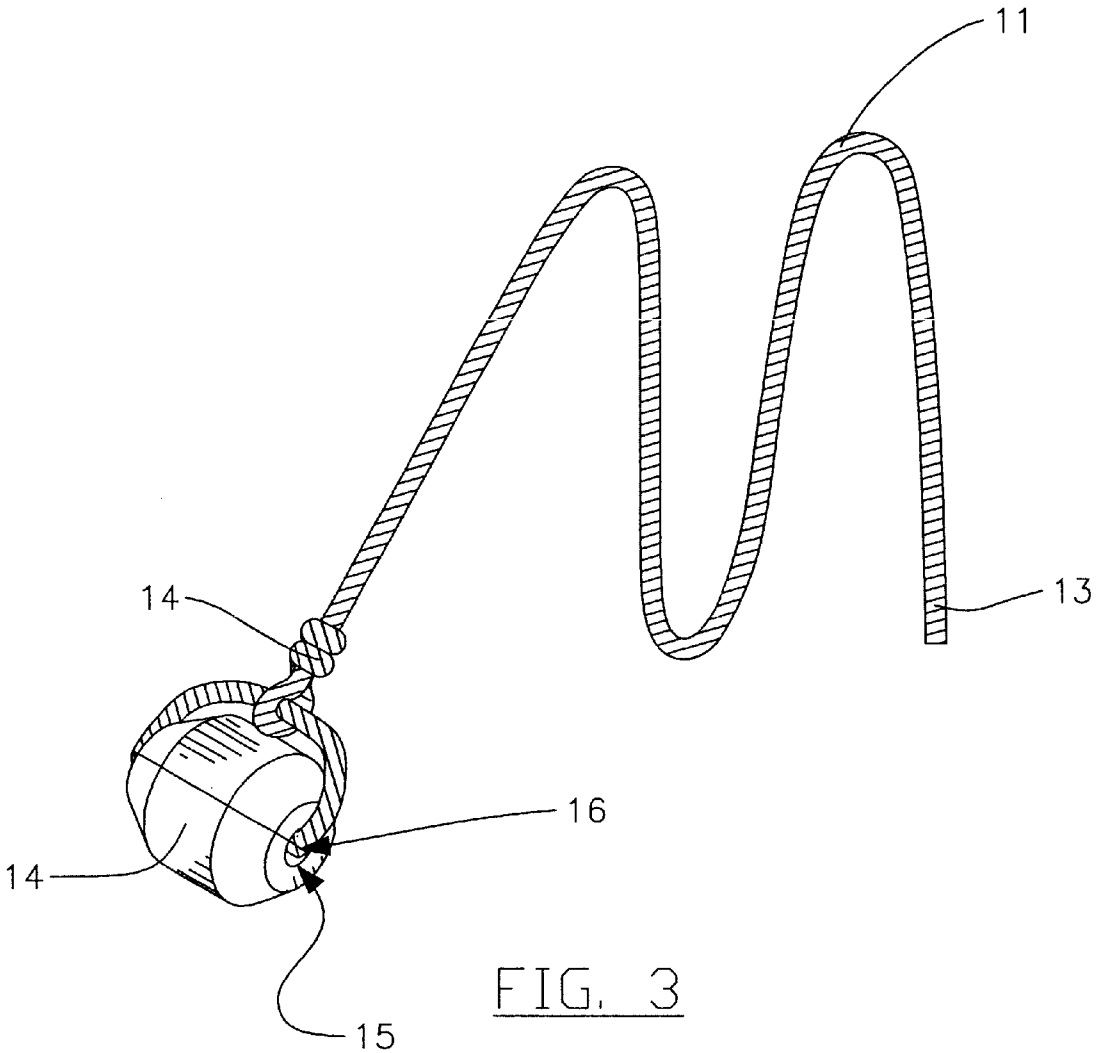
FIG. 3 is a perspective view of the present invention.
Figure 4:
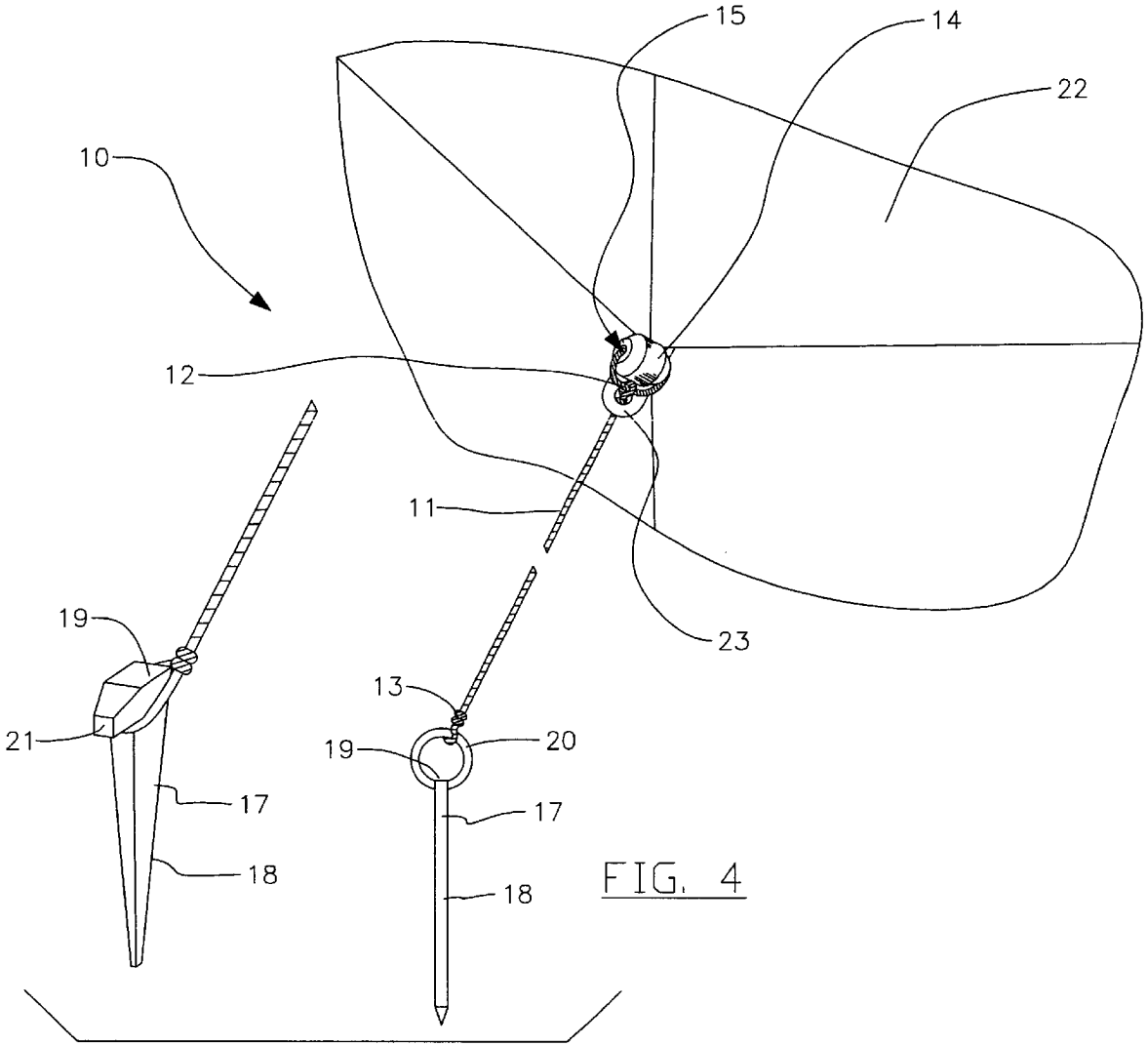
FIG. 4 is a perspective view of the embodiment of the present invention shown in use.

With reference now to the drawings, and in particular to FIGS. 1 through 4 thereof, a new tent tie-down device embodying the principles and concepts of the present invention and generally designated by the reference numeral 10 will be described.

As best illustrated in FIGS. 1 through 4, the tent tie-down device 10 generally comprises a flexible line 11 having a first end portion 12 and a second end portion 13 with the first end portion 12 of the flexible line 11 being adapted to extend through an eyelet 23 of a tent 22 with the flexible line 11 being essentially made of nylon.

The tent tie-down device 10 also includes a bead member 14 having open ends 15 and a bore 16 extending therethrough and being adapted to receive the first end portion 12 of the flexible line 11. The bead member 14 is securely attached to the first end portion 12 of the flexible line 11 with the bead member 14 being adapted to be relatively larger than the eyelet 23 of the tent 22 so that the bead member 14 cannot pass through the eyelet 23. The first end portion 12 of the flexible line 11 is fastened upon itself to form a loop to which the bead member 14 is securely retained.

The tent tie-down device 10 further includes a stake member 17 having a shaft portion 18 and a head portion 19 to which the second end portion 13 of the flexible line 11 is securely fastened.

As a first embodiment, the head portion 19 of the stake member 17 is a ring member 20 with the second end portion 13 of the flexible line 11 being fastened upon itself to essentially form a loop to which the ring member 20 is securely retained.

As a second embodiment, the head portion 19 of the stake member 17 includes a flange portion 21 with the second end portion 13 of the flexible line 11 being fastened upon itself to essentially form a loop which is fastened and tied about the stake member 17 below the flange portion 21.

In use, the user slides the flexible line 11 through the eyelet 23 of the tent 22 with the bead member 14 essentially holding the flexible line 11 to the eyelet 23, since the bead member 14 is too large to pass through the eyelet 23. The user then ties the second end portion 13 about the head portion 19 of the stake member 17 and inserts the shaft portion 18 of the stake member 17 into the ground with the flexible line 11 pulling on the tent 22 to set up the tent 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tent tie-down device comprising:

a flexible line having a first end portion and a second end portion;

a bead member having open ends and a bore extending therethrough and being adapted to receive said first end portion of said flexible line, said bead member being attached to said first end portion of said flexible line; and a stake member having a shaft portion and a head portion which is removably attached to said second end portion of said flexible line.

2. A tent tie-down device as described in claim 1, wherein said first end portion of said flexible line is adaptable to extend through an eyelet of a tent with said flexible line being essentially made of nylon.

3. A tent tie-down device as described in claim 2, wherein said bead member is adaptable to be relatively larger than the eyelet of the tent so that said bead member cannot pass through the eyelet.

4. A tent tie-down device as described in claim 3, wherein said first end portion of said flexible line is fastened upon itself to form a loop to which said bead member is securely retained.

5. A tent tie-down device as described in claim 4, wherein said head portion of said stake member is a ring member, said second end portion of said flexible line being fastened upon itself to essentially form a loop to which said ring member is securely retained.

6. A tent tie-down device as described in claim 4, wherein said head portion of said stake member includes a flange portion, said second end portion of said flexible line being fastened upon itself to essentially form a loop which is fastened about said stake member below said flange portion.

7. A tent tie-down device comprising:

a flexible line having a first end portion and a second end portion, said first end portion of said flexible line being adapted to extend through an eyelet of a tent with said flexible line being essentially made of nylon;

a bead member having open ends and a bore extending therethrough and being adapted to receive said first end portion of said flexible line, said bead member being attached to said first end portion of said flexible line, said bead member being adaptable to be relatively larger than the eyelet of the tent so that said bead member cannot pass through the eyelet, said first end portion of said flexible line being fastened upon itself to form a loop to which said bead member is securely retained; and a stake member having a shaft portion and a head portion to which said second end portion of said flexible line is securely fastened.

8. A tent tie-down device as described in claim 7, wherein said head portion of said stake member is a ring member, said second end portion of said flexible line being fastened upon itself to essentially form a loop to which said ring member is securely retained.

9. A tent tie-down device as described in claim 7, wherein said head portion of said stake member includes a flange portion, said second end portion of said flexible line being fastened upon itself to essentially form a loop which is fastened about said stake member below said flange portion.

* * * * *